US006742370B2

(12) United States Patent
Spencer et al.

(10) Patent No.: US 6,742,370 B2
(45) Date of Patent: Jun. 1, 2004

(54) HIGH FIN DENSITY COIL DESIGN UTILIZING PRECOATED FIN STOCK

(75) Inventors: Steven J. Spencer, Liverpool, NY (US); Paul S. Sacks, Cazenovia, NY (US)

(73) Assignee: Carrier Corporation, Farmington, CT (US)

( * ) Notice: Subject to any disclaimer, the term of this patent is extended or adjusted under 35 U.S.C. 154(b) by 66 days.

(21) Appl. No.: 10/109,283

(22) Filed: Mar. 28, 2002

(65) Prior Publication Data

US 2003/0183377 A1 Oct. 2, 2003

(51) Int. Cl.[7] ..... B21D 54/03
(52) U.S. Cl. ..... 72/46; 29/890.047
(58) Field of Search ..... 29/890.047; 72/46

(56) References Cited

U.S. PATENT DOCUMENTS 1,740,098 A * 12/1929 Karmazin ..... 29/890.039

4,494,288 A * 1/1985 Nagai et al. ..... 29/890.047

* cited by examiner

*Primary Examiner*—Lowell A. Larson
(74) *Attorney, Agent, or Firm*—Wall Marjama & Bilinski LLP

(57) ABSTRACT

A method of manufacturing metal fins suitable for use in a heat exchanger which includes providing a coated patterned fin stock having a series of parallel stripes disposed longitudinally across the width of one surface of the fin stock. The stripe pattern is evenly spaced in the central portion of the fin stock, and staggered or more further spaced apart at the edges of said fin stock. The fin stock is passed through a series of forming dies to form or draw a plurality of tube receiving collared holes in the fin stock, followed by slitting or cutting the fin stock longitudinally to form a plurality of fin strips. The staggered spacing compensates for transverse movement of the fin stock during the drawing operation, and assures for accurate positioning of the collars between the fin stripes. The invention also includes the use of the fins in a high density coil design for use in a heat exchanger.

3 Claims, 2 Drawing Sheets

HIGH FIN DENSITY COIL DESIGN UTILIZING PRECOATED FIN STOCK

BACKGROUND OF THE INVENTION

The present invention relates in general to heat exchangers and more specifically to a high fin density coil design utilizing precoated fin stock.

The use of fins attached to fluid containing tubes to dissipate heat from a contained liquid is well known. Generally, a series of tubes carry heated liquid and form a cooling system. The tubes have metal fins attached thereto which form heat dissipating means. The fins are typically made of aluminum or copper.

The fins may be elongated, thin strips of aluminum with the width and length of the fins depending upon the number, diameter and configuration of the tubes. Generally, the fins may be held in place by a force fit over the tubes or may be adhered to the tubes by solder.

In order to provide an aesthetically pleasing look, it has been found advantageous to provide a coating on surface of the fins. It has been observed that system performance problems occur due to the thermal resistance typically found on high fin density coil designs when conventional (full coat) precoated fin stock is used for coil construction. These problems are particularly prevalent when a coated fin stock is utilized on a high fin density, >17 FPI (fins per linear inch), and even more so when >20 FPI, in coil designs applicable to residential outdoor products.

It should be noted that low fin density coils (10–15 FPI) don't have as much or a significant amount of thermal resistance due to a coating on the fin stock. It is more important to deal with this problem for high fin density coils.

A problem associated with a uniform coating pattern is such that the pattern near the outer edges of the fin stock, because of the drawing operation within the fin die, results in coating material being forced within the collars and also produces fins having a bare fin edge that will have to be scrapped.

SUMMARY OF THE INVENTION

It is therefore an object of the present invention to overcome the problems of the prior art described above.

It is another object of the present invention to utilize a patterned fin stock which eliminates significant thermal resistance typically present in conventional precoated fin stock used on high fin density heat exchangers.

It is yet another object of the present invention to effectively use a patterned fin stock on high fin density coil designs.

It is a further object of the present invention is to provide a staggered coating pattern to compensate for the drawing operation in forming the fin collars and assure accurate positioning of the coating pattern at the outer edges of the fin stock.

The primary object of the present invention to provide a method of designing a patterned fin stock which eliminates or minimizes coating material from within the collars to insure efficient coil performance across a range of fin densities.

The present invention relates to the use of striped fins on high fin density heat exchangers. High fin density applications have reduced contact between the collars on fins and tubing because of the shortened collar length of the individual fins. Therefore it is important to eliminate precoating from the collars more so than on low fin density applications. In order to overcome the problem of the coating material being drawn into the inside of the fin collar and adversely effecting coil performance, it was determined that the conventional uniform spacing of the fin stripes had to be changed. It was discovered that if the stripe pattern near the edges of the fin stock was spaced further or staggered from the center of the sheet that this effectively compensated for the drawing operation with the fin die.

This concept minimizes the chance of drawing the painted (coated) portion within the collars of the outer row of the fin die, and also avoids the potential of having a bare or uncoated fin edge on the fabricated plate fins from the patterned fin stock. A bare fin edge would present an inconsistent appearance and would have to be scrapped.

BRIEF DESCRIPTION OF THE DRAWINGS

For a further understanding of these and other objects of the invention, reference will be made to the following detailed description of the invention which is to be read in connection with the accompanying drawings, wherein.

DETAILED DESCRIPTION OF THE INVENTION

Figure 1:
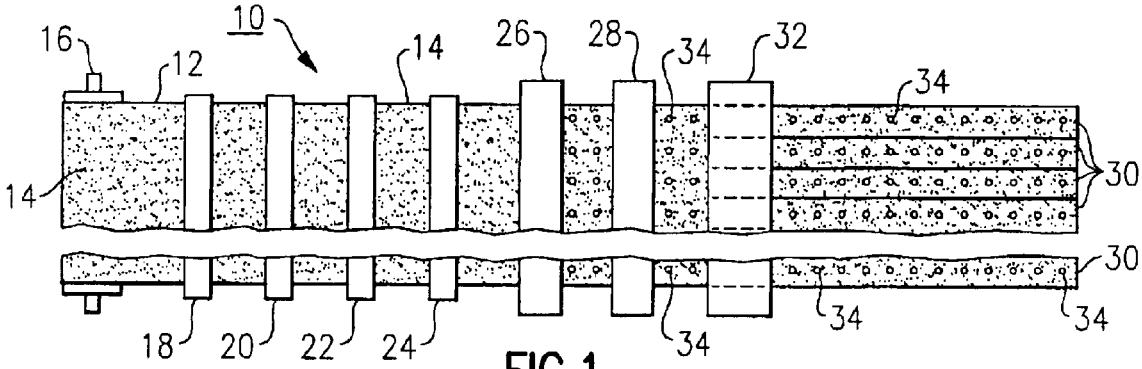
FIG. 1 is a schematic top view of an apparatus for making the fins of the present invention.

Referring now to FIG. 1, there is shown a schematic view of the apparatus 10 for making the fins illustrating an example of the present invention. Because the apparatus may be conventional in cutting and shaping aluminum foil, the details of the individual pieces of equipment are not shown.

Figure 2:
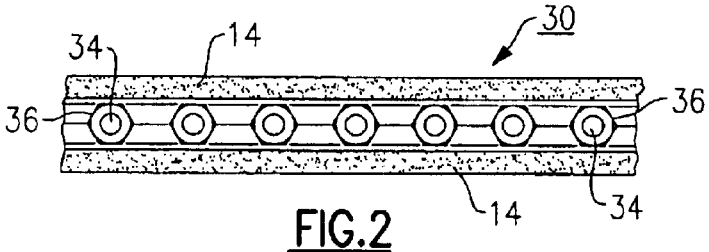
FIG. 2 is an enlarged bottom elevational view of the completed fin of the invention.

A roll of aluminum fin stock 12 is mounted on an axis 16. Axis 16 is a part of a roll unwind system (not shown) which allows an elongated sheet of fin stock 12 to be unwound for further processing. The example fin die makes 48 tube rows of fins having ⅜-inch diameter tubes on a 1.00 inch by 0.75 inch staggered pattern. The fin stock is aluminum having a thickness of 0.004 inch, a width of 36.75 inches and an indeterminate length. Fin stock 12 is fed through a series of 4 draw stations 18, 20, 22 and 24 which form a plurality of collars 36. A hole is punched in each collar at station 26 and the top of the collar flared at station 28. The fin stock is then fed into a slitter 32 which cuts the fin stock along the central axis of the stripes thereby producing individual fins 30 as illustrated in FIG. 2. It should be noted that the top surface of fin stock which has the collar is uniformly coated, while the bottom surface has a series of parallel stripes which are evenly spaced across most of the width of the fin stock, and staggered at the edges which will be explained in greater detail below.

Figure 3:
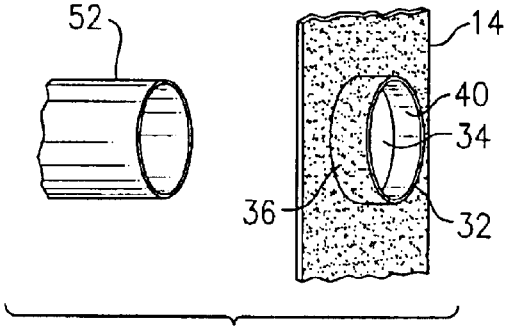
FIG. 3 is an enlarged perspective view of the combination of the tube and fin of the invention prior to final assembly.
Figure 4:
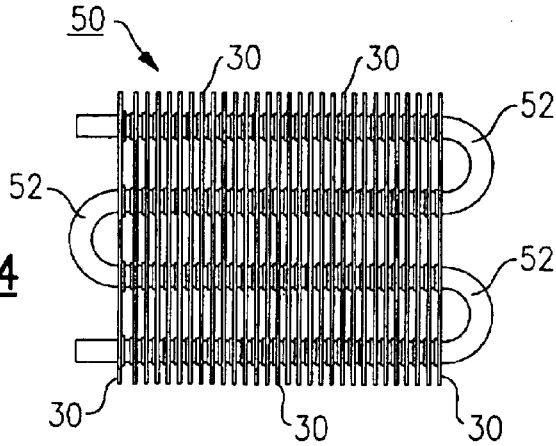
FIG. 4 shows a front schematic view of one embodiment of the assembled heat exchanger of the invention.

FIG. 3 illustrates the combination of a tube 52 and a section of a fin having a collar 36 surrounding a hole 34 which is designed to receive tube 52. FIG. 4 illustrates the assembled heat exchanger 50 which comprises a series of interconnected tubes 52 which fit in holes 40 of fins 30 in which the tubes are held in place by a force fit within collars 36.

Any coating material which will withstand the operating conditions of use can be used to coat the fins. Suitable coating materials include acrylic resin emulsions of the type disclosed in U.S. Pat. No. 4,471,393 which is incorporated herein by reference.

Figure 5:
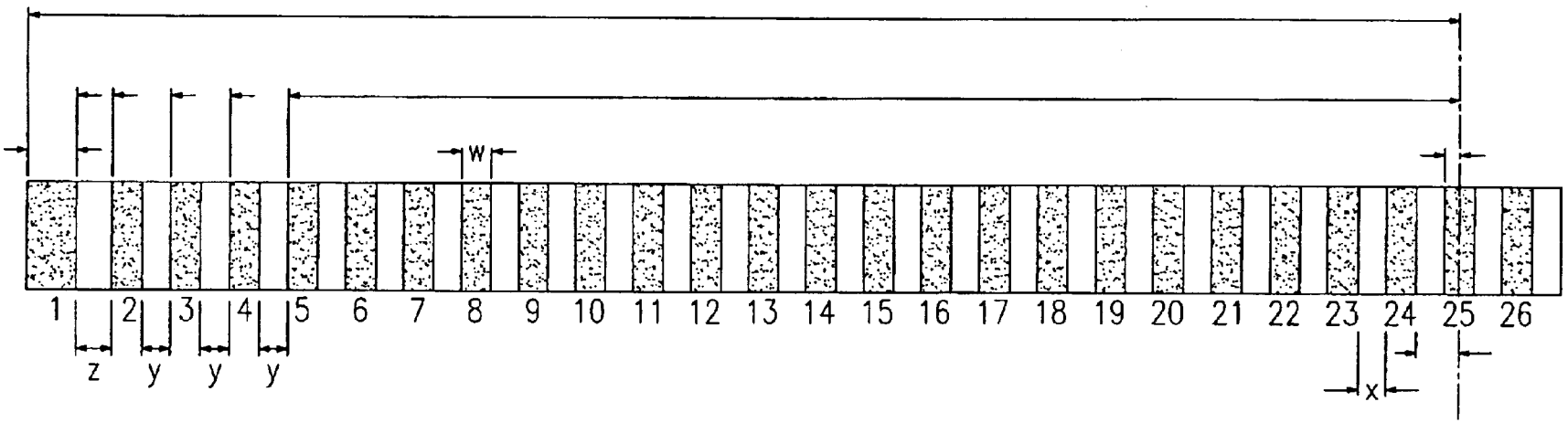
FIG. 5 is a bottom view of one half the width of the fin stock with precoated stripes being staggered at the edges.

FIG. 5 is a bottom view of a segment of one half the width of the fin stock which shows the stripes being substantially evenly spaced parallel to each other. Stripes numbered 5–25 are exactly evenly spaced from each other at a distance x. Stripes 2, 3, 4 and 5 are spaced from each other at a distance y, which is greater than distance x, with stripe 1 being spaced from stripe 2 at a distance z which is greater than distance y. By staggering the pattern of the stripes at the outer edges of the fin stock by increasing the distance between stripes 2, 3, 4 and 5, distance y, and the distance between stripes 1 and 2, being distance z, uniform spacing of the collared holes between the stripes is assured. The degree of adjustment or staggering of the stripe pattern will vary for each drawing operation, but the same concept applies to each situation. For example, in using the 36.75 inch width aluminum fin stock described above, x=0.440 inches; y=0.455 inches and z=0.500 inches. The width of the coated stripe is 0.31 inches. By applying the concept described above, the coating is not drawn into the inside of the collars and the potential of having a bare or uncoated fin edge is avoided (See also FIGS. 2 and 3).

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A method of manufacturing metal fins suitable for use in a heat exchanger having a fin density of at least 17 fins per linear inch which comprises:

(a) providing a coated patterned fin stock having a series of parallel stripes disposed longitudinally across the width of said fin stock, with said stripes being evenly spaced apart in the central portion of said fin stock, and staggered or more further spaced apart at the edges of said fin stock;

(b) passing said fin stock through a series of forming dies to form or draw a plurality of tube receiving collared holes in said fin stock; and (c) slitting or cutting said fin stock longitudinally to form a plurality of fin strips, and whereby said staggered spacing compensates for transverse movement of the fin stock during the drawing operation, and assures for accurate positioning of the collars between said coated stripes.

2. A method of manufacturing metal fins suitable for use in a heat exchanger having a fin density of at least 17 fins per linear inch which comprises:

(a) providing a decorative coated patterned fin stock having a series of parallel stripes disposed longitudinally across the width of said fin stock on one surface thereof, with said stripes being evenly spaced apart in the central portion of said fin stock, and staggered or more further spaced apart at both edges of said fin stock;

(b) passing said fin stock through a series of forming dies to form or draw a plurality of tube receiving collared holes in said fin stock with said collared holes being positioned between two adjacent stripes; and (c) slitting or cutting said fin stock longitudinally to form a plurality of fin strips, and whereby said staggered spacing compensates for transverse movement of the fin stock during the drawing operation, and assures for accurate positioning of the collars between said coated stripes.

3. A method of manufacturing metal fins suitable for use in a heat exchanger having a fin density of at least 17 fins per linear inch which comprises:

(a) providing a coated patterned fin stock having a width defined by two parallel edges, and a top and bottom surface with a series of parallel stripes disposed longitudinally across the width of the bottom surface of said fin stock, with said stripes being evenly spaced apart in the central portion of said fin stock, and staggered or more further spaced apart at the edges of said fin stock;

(b) passing said fin stock through a series of forming dies to form or draw a plurality of tube receiving collared holes in the top surface of said fin stock; and (c) slitting or cutting said fin stock longitudinally to form a plurality of fin strips, and whereby said staggered spacing compensates for transverse movement of the fin stock during the drawing operation, and assures for accurate positioning of the collars between said coated stripes.

* * * * *